United States Patent [19]

Howard et al.

[11] 4,063,961

[45] Dec. 20, 1977

[54] METHOD FOR CLEANING CARPET

[76] Inventors: Lawrence F. Howard, 20599 Barnard Ave., Walnut, Calif. 91789; James W. Mills, 16727 Fellowship, Valinda, Calif. 91744

[21] Appl. No.: 680,070

[22] Filed: Apr. 26, 1976

Related U.S. Application Data

[63] Continuation of Ser. No. 461,859, April 18, 1974, abandoned.

[51] Int. Cl.[2] ..... B08B 1/04; B08B 3/00; B08B 5/04

[52] U.S. Cl. ..... 134/4; 134/6; 134/16; 134/21

[58] Field of Search ..... 134/4, 6, 7, 16, 21; 8/147, 158; 15/22 R, 49 RB, 380, 381

[56] References Cited

U.S. PATENT DOCUMENTS

| | | | |
|---|---|---|---|
| 262,352 | 8/1882 | Beitmiller | 134/16 |
| 1,410,913 | 3/1922 | Gray | 134/7 |
| 2,189,209 | 2/1940 | Jamgotch | 134/21 |
| 2,344,247 | 3/1944 | Hopkins et al. | 134/7 |
| 2,514,142 | 7/1959 | Reid | 15/385 X |
| 2,842,788 | 7/1958 | Rench et al. | 15/410 X |
| 3,615,819 | 10/1971 | Cauley | 134/6 |
| 3,615,820 | 10/1971 | Herrick | 134/6 |
| 3,655,444 | 4/1972 | Young | 134/6 |
| 3,728,075 | 4/1973 | Cannan | 134/6 |
| 3,827,857 | 8/1974 | Boulus | 134/4 |

*Primary Examiner*—Morris O. Wolk
*Assistant Examiner*—Bradley R. Garris
*Attorney, Agent, or Firm*—Lyon & Lyon

[57] ABSTRACT

A method and apparatus for cleaning carpet. The pile of the carpet is first lifted, opened and agitated by stiff rotating brushes and beater bars, separating the foreign matter therein from the pile and bringing the matter to the surface of the carpet. The carpet is then vacuumed removing the separated matter therefrom. A film of cleaning agent is then sprayed through a hand-held wand over the carpet encapsulating the carpet fibers. The wand communicates with a portable pressurized supply of cleaning agent. After a short setting, the carpet is scrubbed with counter-rotating or rotary brushes. The agent is then allowed to dry and the residue removed with a vacuum.

9 Claims, 7 Drawing Figures

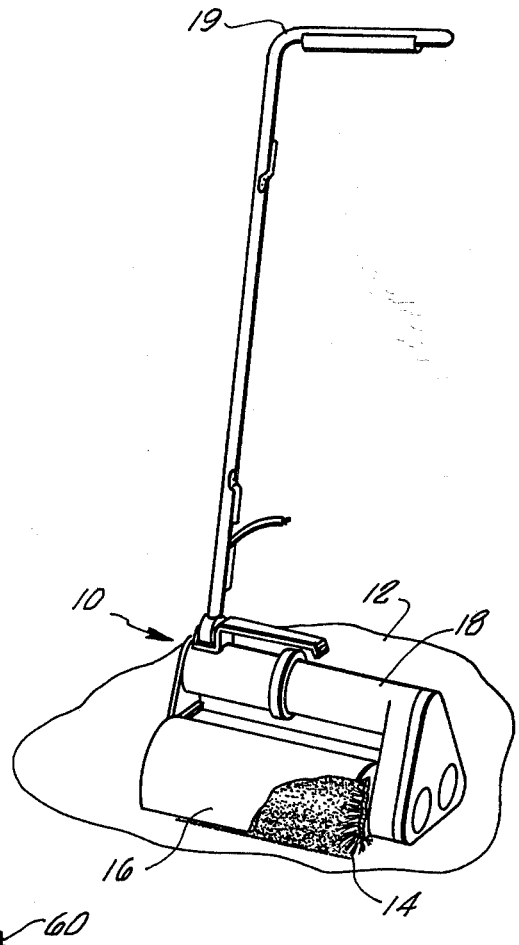
FIG. 1
FIG. 2
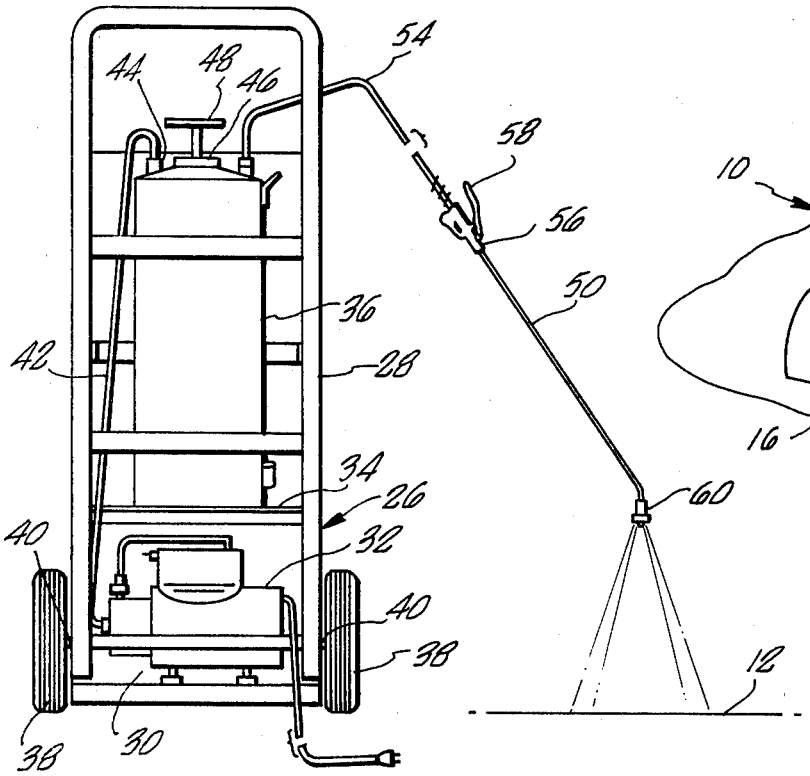
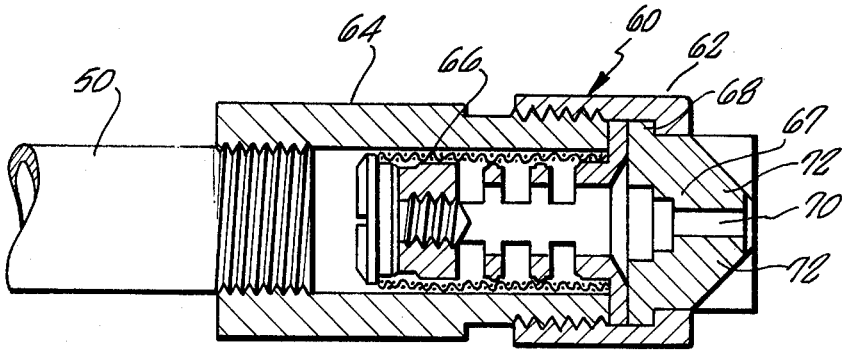
FIG. 3

METHOD FOR CLEANING CARPET

This is a continuation of application Ser. No. 461,859, filed Apr. 18, 1974 and now abandoned.

BACKGROUND OF THE INVENTION

There are currently available several different methods and machines for cleaning carpet. However, each approach heretofore available has several shortcomings associated therewith, one of which is saturation. When a carpet is saturated with water or a cleaning agent, not only must the carpet remain unused for an extended drying period, but the glue which secures the carpet fibers to the carpet backing and which joins adjacent carpet sections often deteriorates, releasing the carpet fibers from the backing and separating carpet sections along the seams therebetween. While damage to the carpet resulting from the breakdown of the adhesive quality of the glue therein is certainly a problem of grave concern, the period during which the saturated carpet is drying and cannot be used is now being recognized in certain areas as a problem of even greater economic concern. When the carpet in an airplane is saturated as a result of the cleaning of the carpet therein, that plane cannot be used to transport passengers. Even with the use of drying equipment, the carpet often takes up to 12 hours to dry resulting in an extensive downtime for the plane and a corresponding loss of income. Similarly, it would often be desirable to clean carpet in public places such as theaters and museums without having to close such places to traffic. To reduce this down or closed period, it is necessary to eliminate the saturation of the carpet during a cleaning process.

A common method of cleaning carpets is that of steam cleaning. In a steam cleaning operation, water of 160°–180° F is forced into the carpet down into the padding and subsequently drawn out. During such a process, the carpet is completely saturated and the drawing out of some of the water often pulls the brown padding back through the pile leaving small spots as it passes up through the carpeting. Thus, steam cleaning has the disadvantage of saturation as well as carpet spotting. Attempts have been made to avoid carpet saturation with the advent of dry cleaning and the use of dry foam. In the dry cleaning operation, an absorbant material such as sawdust is soaked in a cleaning agent and distributed over the carpet. The material is then brushed into the carpet, spreading the cleaning agent and absorbing some of the dirt and other foreign matter on the carpet fibers. The sawdust is then removed by vacuuming. This method of carpet cleaning, however, generally does not provide a thorough cleaning of the carpet and invariably some of the absorbant material is left behind on the carpet. As soon as the carpet is then subjected to traffic, this material with its absorbed dirt and foreign matter is ground back into the carpet, soiling the same.

In a dry foam operation, a foam cleaning agent is desposited on the carpet, worked into the carpet with brushes and then vacuumed and allowed to dry. This method of carpet cleaning, however, cannot provide an adequate sitting time during which the cleaning agent can chemically interact with the dirt on the carpet fibers as the foam will lie atop the carpet fibers prior to brushing the foam into the carpet, and so much of the dirt is left in the carpet after and vacuuming. Applicant's method and apparatus for cleaning carpet avoids the saturation problem with which the foaming method is concerned, yet allows the cleaning agent to encapsulate the fibers and chemically interact with the foreign material thereon thereby thoroughly cleaning the carpet with a minimum of downtime.

SUMMARY OF THE INVENTION

Briefly, the invention comprises a method and apparatus for cleaning carpet. Foreign matter is first separated from the carpet fibers through physical agitation and then removed from the carpet by vacuuming. A film of cleaning agent is then sprayed through a handheld wand over the carpet so that the agent encapsulates the fibers of the carpet and interacts with the foreign matter thereon to remove the matter from the carpet fibers. After allowing the cleaning agent to interact with the foreign material in the carpet fibers, the carpet is scrubbed with brushes causing further interaction between the cleaning agent and the foreign matter in the carpet. The agent is then allowed to dry and the residue removed with a vacuum.

It is the object of this invention to provide an improved method and apparatus for cleaning carpet.

It is another object of this invention to provide a method for cleaning carpet which avoids saturation of the carpet.

It is a further object of this invention to provide a method and apparatus for cleaning large areas of carpeting in a short period of time.

It is yet another object of this invention to provide apparatus for cleaning carpet which is more flexible in use than the equipment heretofore available.

Other objects and advantages of the present invention will become apparent from the following detailed description taken in conjunction with the accompanying drawings.

DESCRIPTION OF THE DRAWINGS

FIG. 1 is an isometric view of the agitating device with a portion being broken away to illustrate one of the two cylindrical brushes for raising the carpet pile and removing foreign matter therefrom.

FIG. 2 is a frontal view of the carpet spraying device and supporting structure.

FIG. 3 is an enlarged sectional view of the spraying nozzle.

Referring now in detail to the drawings, FIG. 1 illustrates the agitating device 10 which is generally used for lifting, opening and agitating the pile of the carpet 12. This device is essentially comprised of a pair of counter-rotating cylindrical brushes 14 (one being shown and the other being disposed therebehind), housing 16, a drive mechanism 18 for imparting counter-rotational movement to the brushes and an extended handle 19. As the device 10 is moved over the carpet, the brushes 14 are rotated on their axes in opposite directions, lifting and opening the carpet pile and separating the foreign matter therein from the fibers. After the carpet pile has been raised and foreign matter separated therefrom, an industrial vacuum 21 (see FIG. 4) equipped with beater bars 23 is directed over the same area of carpet. The rotating movement of the beater bars further agitates the carpet, separating additional foreign matter therefrom, which, together with the matter previously separated by the agitating device 10, is removed by the suction action of the vacuum 21. This initial brushing, beating and vacuuming operation removes approximately 98% of the foreign matter from the pile of the carpet. Conventional vacuuming prior to carpet cleaning which is practiced in the procedures heretofore available leaves a substantial amount of that foreign material in the carpet making the subsequent cleaning operation considerably more difficult and less effective.

Figure 5:
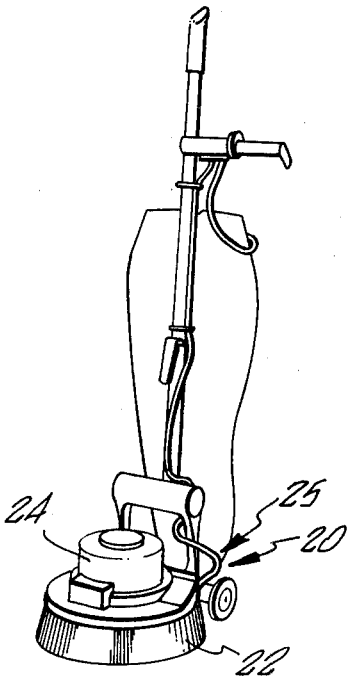
FIG. 5 is an isometric view of the osicillating vacuum machine used with low profile carpets.

While the above-described agitating and vacuuming apparatus 10 and 21 is used with most carpets, when practicing the process of this invention on low profile carpet such as indoor-outdoor or looped pile carpet, which generally have a profile of about $\frac{1}{4}$ to $\frac{3}{8}$ inch, an oscillating vacuum machine 20 is used; see FIG. 5. This machine differs from the counter-rotating apparatus previously described in that it employs a single large circular brush 22 which is caused to undergo oscillatory motion by the drive means 24. The combination of this oscillatory brush movement and the additional weight of the machine (80 to 90 pounds as opposed to 20 to 25 pounds for counter-rotating machines) has been found to be superior to the counter-rotating machines 10 in raising the pile of this low profile carpet. In addition, the oscillating device 20 shown in FIG. 5 incorporates vacuum assembly 25, thereby eliminating the need for a subsequent vacuuming operation as the foreign matter is lifted from the carpet as soon as it is separated therefrom by the oscillating movement of brush 22.

Figure 4:
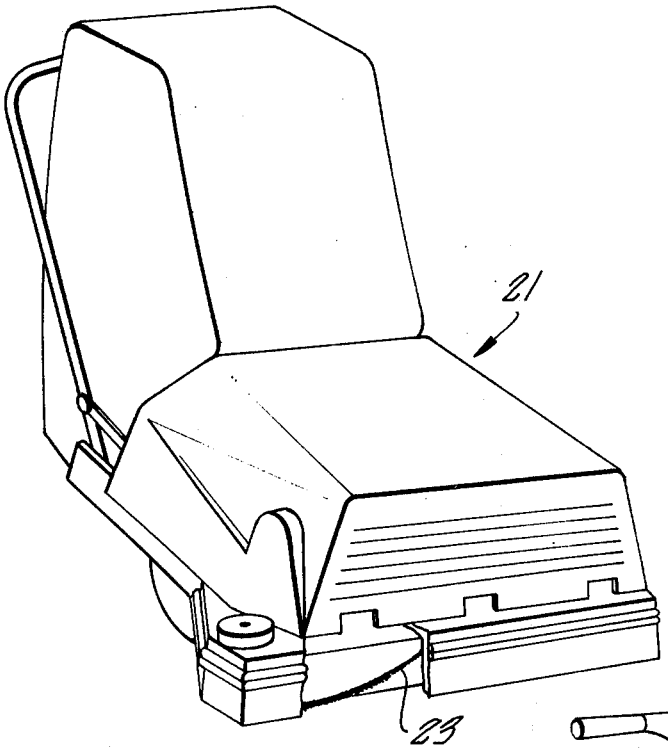
FIG. 4 is an isometric view of the vacuum assembly used in conjunction with the agitating device of FIG. 1.

The next step in the carpet cleaning process is the spraying of the carpet fibers with a film of cleaning agent. The device for spraying the cleaning agent is shown in FIG. 2 and is seen to be comprised of a cart 26 having a supporting frame structure 28, a lower shelf 30 for supporting a compressor 32, an upper shelf 34 for supporting the spraying tank 36 and wheels 38 mounted on axle 40. The compressor 32 continually supplies the spraying tank 36 with compressed air through line 42 and check valve 44. The tank is provided with a screw-type cap 46 having an extended handle portion 48 thereon. A wand 50 is in fluid communication with the tank 36 through a flexible rubber hose 54. A hand-operated valve 56 is disposed at the upstream end of the wand 50. The valve has a handle portion 58 by which the operator can regulate the flow of cleaning agent through nozzle 60. The nozzle shown in detail in FIG. 3 is seen to be comprised of an enlarged threaded end portion 62 which is adapted for threaded engagement with coupling 64. A cylindrical wire filtering member 66 is disposed inwardly of threaded coupling member. A nozzle tip 67 having an enlarged flange portion 68 is disposed within the coupling 64 downstream of filter 66. The nozzle tip 67 has an aperture 70 therein which is disposed between two sloping wall surfaces 72 to provide a fan pattern for the cleaning agent as it exits the nozzle. In use, after the carpet pile has been lifted and opened and almost all of the foreign material removed therefrom by the agitating and vacuuming apparatus shown in FIGS. 1 and 4, an area of about 20–25 square feet of carpeting is sprayed with the cleaning agent through the device described above as shown in FIG. 2. The rubber hose which communicates the wand with the tank of cleaning agent is preferably about 25 feet long so that the entire area can be sprayed without having to move the spraying carriage. The use of the fan patterned nozzle tip allows the person spraying the carpet fabric to spray about fixtures on the floor without the necessity of having to move the fixtures or subject them to being covered with the cleaning agent. In using the device, the nozzle tip is generally maintained at a distance of about 10 inches to two feet above the floor. The carpet is initially predamped by a quick passage thereover with the wand. The sprayer then repeats the spraying operation, to maintain a mist on top of the carpet. This mist tends to encapsulate the carpet fibers and to chemically interact with any dirt or other foreign material remaining therein, thereby loosing the matter from the fibers.

Figure 6:
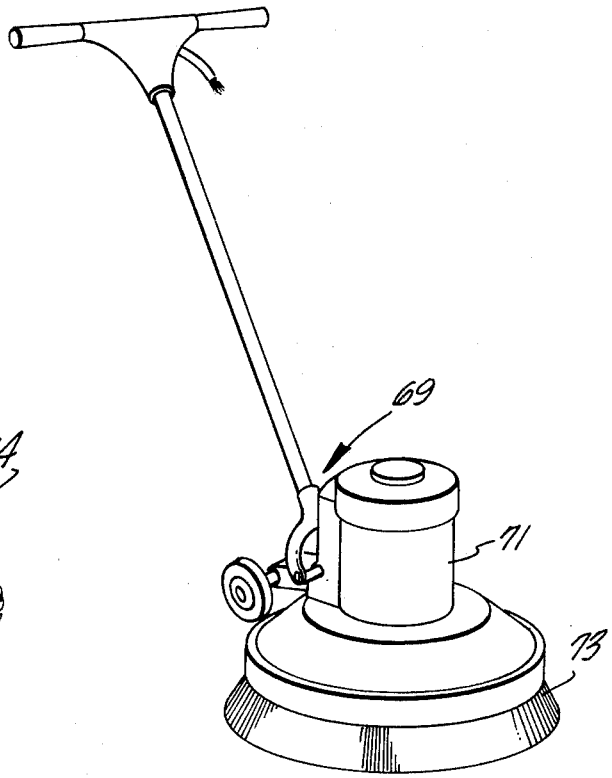
FIG. 6 is an isometric view of the rotary agitating device used for scrubbing the encapsulated carpet fibers.

After about three to five minutes during which the cleaning agent is encapsulating and interacting with the foreign matter on the carpet fibers, the carpet and cleaning agent is severely agitated. This agitation scrubs the carpet thoroughly with the cleaning agent to remove any remaining foreign matter. As with the initial step of lifting the carpet pile, the preferred apparatus for agitating the encapsulated fibers depends on the type of carpet being cleaned. As in the prior step, if the carpet is shag, high-low (cut and looped), random sheared or plush carpet having a single level cut pile surface, the counter-rotating agitating device 10 is used. If, however, the carpet is low profile such as indoor-outdoor or looped pile, a rotary brush agitator 69 such as that shown in FIG. 6 has been found to be preferrable. The rotary machine has a single brush 73 to which rotary motion is imparted by drive assembly 71. This rotary machine, as the oscillating machine 20 weighs about 80 to 90 pounds, which is advantageous in agitating low profile carpet.

Figure 7:
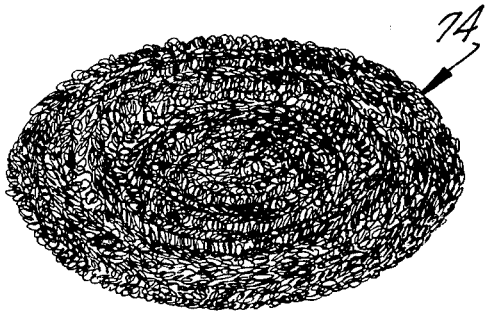
FIG. 7 is an isometric view of a scrubbing pad.

After the carpet has been agitated with either the counter-rotating or single rotating brushes, if the carpet is a long shag type with fibers over one inch in length, the pile is then erected with a manual pile or push brush. This step is generally omitted with other types of carpets. The carpet (all types) is then scrubbed with yarn pad 74 such as that sold under the trademark SECO by Seco Industries (see FIG. 7). This pad is comprised of looped yarn and is placed under the circular brush 73 on a rotary brush agitator 69. The rotary movement of the yarn among the carpet fibers loosens any deeply embedded soil and massages the carpet fibers, removing any remaining dirt or other foreign matter therefrom. While the process of this invention can be carried out without this step, it has been found that the use of such a pad improves the cleaning process.

The carpet is then allowed to dry. Because the carpet has not been saturated, this drying period is generally not more than one and one-half hous and in certain instances where the air is quite warm and dry, the time can be as short as one-quarter of an hour. With the longer fiber carpets it is desirable, after scrubbing with the yarn pad, to manually raise the pile with a brush to quicken the drying process. The cleaning agent, to be described, drys in crystalline form and therefore can be readily removed from the carpet with a vacuum cleaner. After the final step of vacuuming, the carpet cleaning process is complete.

The cleaning agent used in the above-described process is a single phase aqueous composition comprised of substantially equal parts of the following: a neutral anionic dry foam shampoo of the sodium lauryl sulfate type; a noncaustic water base degreaser of the glycol ether type; a drying agent such as isopropyl alcohol, sodium perborate and an ammonical solution of styrene maleic anhydride to provide a resoiling agent. This composition is stable, has a pH of 8.5 or above and has been found to be extremely effective when used in the above-described process in encapsulating the carpet fibers and removing the foreign matter therefrom without need for saturation.

Various changes and modifications may be made in carrying out the present invention without departing from the spirit and scope thereof. Insofar as these changes and modifications are within the purview of the appended claims, they are to be considered as part of the invention.

I claim:

1. A process for cleaning shag type carpet comprising the sequential steps of lifting, opening and agitating the carpet pile with counter-rotating brushes, beating and vacuuming the carpet to remove over 95% of the foreign matter therefrom, applying a mist of cleaning agent over the carpet to encapsulate the fibers thereof, allowing the cleaning agent to remain in a quiescent state for a period of at least 2 minutes, agitating the carpet pile with the cleaning agent thereon with counter-rotating brushes, allowing the carpet to dry and vacuuming the carpet.

2. The process of claim 1 further including the step of scrubbing the carpet with yarn pad after said step of agitating the carpet with the cleaning agent thereon.

3. The process of claim 1 further including the step of brushing the carpet to erect the carpet pile after said step of agitating the carpet with the cleaning agent thereon and prior to the step of scrubbing the carpet with a yarn pad.

4. The process of claim 3 including the additional steps of brushing the carpet to erect the carpet pile after said step of scrubbing the carpet with a yarn pad.

5. A process for cleaning carpet with a profile having about $\frac{1}{4}$ to $\frac{3}{8}$ inch high fibers comprising the sequential steps of lifting, opening and agitating the carpet pile with an oscillatory brush and vacuuming the carpet to remove over 95% of the foreign matter therefrom, applying a mist of cleaning agent over the carpet fibers, allowing the cleaning agent to remain in a quiescent state for a period of at lease two minutes, agitating the carpet pile with the cleaning agent thereon with a rotary brush, allowing the carpet to dry and vacuuming the carpet.

6. The process of claim 5 further including the step of scrubbing the carpet with a yarn pad after said step of agitating the carpet with the cleaning agent thereon.

7. A process for cleaning high-low carpets comprising the sequential steps of lifting, opening and agitating the carpet pile with counter-rotating brushes and vacuuming the carpet to remove over 95% of the foreign matter therefrom, applying a mist of cleaning agent over the carpet to encapsulate the fibers thereof, allowing the cleaning agent to remain in a quiescent state for a period of at least two minutes, agitating the carpet pile with the cleaning agent thereon with rotating brushes, allowing the carpet to dry and vacuuming the carpet.

8. The process of claim 7 further including the step of scrubbing the carpet with a yarn pad after said step of agitating the carpet with the cleaning agent thereon.

9. The process of claim 8 further including the step of brushing the carpet to erect the carpet pile after said step of scrubbing the carpet with a yarn pad.

* * * * *